United States Patent [19]

Hallcher et al.

[11] 4,101,392

[45] Jul. 18, 1978

[54] PROCESS FOR ELECTROLYTIC OXIDATIVE METHYL-METHYL COUPLING OF CRESOL SALTS

[75] Inventors: Richard C. Hallcher, Maryland Heights; Manuel M. Baizer, St. Louis, both of Mo.

[73] Assignee: Monsanto Company, St. Louis, Mo.

[21] Appl. No.: 753,652

[22] Filed: Dec. 22, 1976

[51] Int. Cl.[2] ..... C25B 3/10

[52] U.S. Cl. ..... 204/59 R; 204/72; 204/78

[58] Field of Search ..... 204/78, 73 R, 59 R, 204/72

[56] References Cited

U.S. PATENT DOCUMENTS 3,756,928 9/1973 Eisele et al. ..... 204/59 R

OTHER PUBLICATIONS

Vermillion et al., J. Electrochemical Soc., pp. 1392–1394, 12/64.

Vermillion et al., J. Electrochem. Soc. vol. III, pp. 1392–1400, 12/66.

*Primary Examiner*—F.C. Edmundson

*Attorney, Agent, or Firm*—Wendell W. Brooks; John D. Upham

[57] ABSTRACT

Cresol salts substituted with non-interfering, blocking substituents at least at the 2,4,6-positions relative to the phenolic oxyanion where at least one of the substituents is the cresolic methyl are electrolytically oxidized to yield methyl-methyl coupled dehydrodimeric cresols.

21 Claims, No Drawings

PROCESS FOR ELECTROLYTIC OXIDATIVE METHYL-METHYL COUPLING OF CRESOL SALTS

BACKGROUND OF THE INVENTION

This invention relates to an improved process for the electrolytic oxidation of appropriately substituted cresol salts to produce the corresponding methyl-methyl coupled dehydrodimeric cresols. More particularly, this invention relates to an improved process for the electrolytic oxidative methyl-methyl coupling of cresol salts substituted with non-interfering, blocking substituents at least at the 2,4,6-positions relative to the phenolic oxyanion where at least one of the substituents is the cresolic methyl to produce methyl-methyl coupled dehydrodimeric cresols, or simply 1,2-bis(hydroxyaryl)ethanes.

The electrolytic oxidation of cresol salts substituted with non-interfering, blocking substituents at least at the 2,4,6-positions relative to the phenolic oxyanion where at least one of the substituents is the cresolic methyl to produce methyl-methyl coupled dehydrodimeric cresols is taught in copending application, Ser. No. 646,725, filed Jan. 5, 1976 to Richard C. Hallcher and entitled "Electrolytic Oxidative Methyl-Methyl Coupling of Cresol Salts," which application is assigned to the same assignee as in the present case.

Oxidative methyl-methyl coupling of cresols has previously been accomplished particularly to prepare the corresponding 1,2-bis(hydroxyaryl)ethanes, by the use of a variety of oxidizing agents. For example, oxidizing agents such as alkaline potassium hexacyanoferrate(III), lead(IV)oxide, silver oxide, air in cumene containing iron(III)stearate, air in chlorobenzene containing 2,2'-azobis(2-methylpropanenitrile)($\alpha,\alpha'$-azobisisobutyronitrile), organic peroxides, and the like have been used for this purpose. Each of these known reagents have certain disadvantages when used in this reaction. These may include low yield, simultaneous production of contaminating by-products such as stilbenequinone structures, and the necessity of using extremely dilute solutions and long reaction periods. Moreover, some of the reagents are relatively expensive.

The disadvantages encountered in the prior art chemical oxidative methyl-methyl coupling processes are overcome by the discovery that appropriately substituted cresol salts undergo electrolytic oxidation to produce methyl-methyl coupled dehydrodimeric cresols [1,2-bis(hydroxyaryl)ethanes].

The improvement of the present invention rests in the discovery that an unexpected surprisingly greater yield of methyl-methyl coupled dehydrodimeric cresol product can be obtained by conducting the electrolysis in a liquid electrolysis medium comprising the cresol salt, the corresponding free cresol, and solvent, wherein the molar equivalent ratio of cresol salt to free cresol is no more than about 1.0 molar equivalent of cresol salt to about 5.0 molar equivalents of free cresol.

Various other advantages of this invention will become apparent from the accompanying description and claims.

SUMMARY OF THE INVENTION

According to the present invention it has been discovered that cresol salts substituted with non-interfering, blocking substituents at least at the 2,4,6-positions relative to the phenolic oxyanion where at least one of the substituents is the cresolic methyl can be electrolytically oxidized in an electrolysis medium comprising such cresol salt, the corresponding free cresol, and solvent, wherein the molar equivalent ratio of cresol salt to free cresol is no more than about 1.0 molar equivalent of cresol salt to about 5.0 molar equivalents of free cresol to yield methyl-methyl coupled dehydrodimeric cresols.

The methyl-methyl coupled dehydrodimeric cresol products obtained in the present process can be recovered by any of a number of well-known procedures as the free dehydrodimeric cresol or derivatives thereof, such as, for example, the corresponding diacyloxy compounds.

DETAILED DESCRIPTION OF THE INVENTION

Cresol salts substituted with non-interfering, blocking substituents at least at the 2,4,6-positions relative to the phenolic oxyanion where at least one of the substituents is the cresolic methyl are electrolytically oxidized to yield methyl-methyl coupled dehydrodimeric cresols [1,2-bis(hydroxyaryl)ethanes].

The term "non-interfering, blocking substituents" is employed herein to mean substituents which (a) can be present in the cresol salt without causing substantial adverse alteration of either the course of the desired oxidative methyl-methyl coupling of such cresol salts nor the yield of the desired product under process conditions; and (b) are used to block reactive ring positions, such as, for example, the 2,4,6- or ortho- and para- positions relative to the phenolic oxyanion so as to substantially eliminate undesired oxidative ring-to-ring as well as ring-to-oxygen coupled products.

In accordance with the present process, an electric current is passed through a liquid electrolysis medium comprising the cresol salt, the corresponding free cresol, and solvent, wherein the molar equivalent ratio of cresol salt to free cresol is no more than about 1.0 molar equivalent of cresol salt to about 5.0 molar equivalents of free cresol. As a result, the possibility of side reactions, for example, carbon-oxygen coupling to produce desirable by-products is substantially eliminated.

Equations (1) and (2) show the reaction involved in the present process, the preparation of 1,2-bis(3,5-disubstituted-hydroxyaryl)ethanes from a 2,6-disubstituted-4-methylphenoxide and a 2,4-disubstituted-6-methylphenoxide, respectively, being used for purposes of illustration.

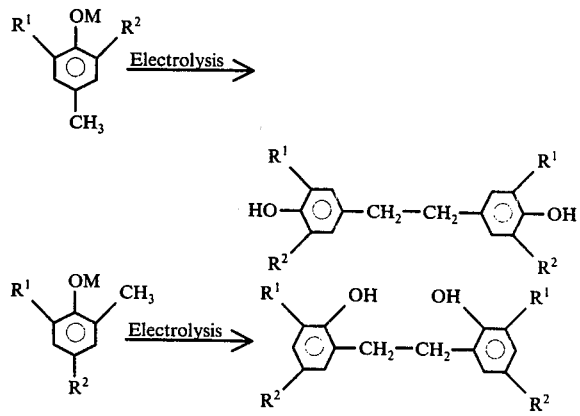

Where the substituents ($R^1$ and $R^2$ as defined hereinbelow) in the 2,6-disubstituted-4-methylphenoxide and the 2,4-disubstituted-6-methylphenoxide are alkyls, the products shown in Equations (1) and (2), respectively, will be a 1,2-bis(3,5-dialkyl-4-hydroxyphenyl)ethane and a 1,2-bis(2-hydroxy-3,5-dialkylphenyl)ethane. For example, the product in Equation (1) where $R^1$ and $R^2$ are t-butyls is 1,2-bis(3,5-di-t-butyl-4-hydroxyphenyl)ethane and the product in Equation (2) where $R^1$ and $R^2$ are methyls is 1,2-bis-(2-hydroxy-3,5-dimethylphenyl)ethane.

From the above general description it is apparent that the 2,4,6-trimethylphenoxide exhibits a high selectivity toward the ortho methyl-methyl coupled dehydrodimeric cresol product to the substantial exclusion of the corresponding para methyl-methyl coupled product. Indeed, the high selectivity exhibited thereby is quite surprising and unexpected in view of the products such as the para methyl-methyl coupled product and the ortho-para methyl-methyl coupled product obtained by means of chemical oxidation of 2,4,6-trimethylphenol. For example, in the silver oxide oxidation of 2,4,6-trimethylphenol, as described in McNelis, U.S. Pat. No. 3,293,307, the para methyl-methyl coupled product is favored almost exclusively, while the air in cumene containing iron(III) stearate (ferric stearate) oxidation, as described in Moore et al, *Journal of the Chemical Society*, 243 (1954), produces a mixture of both the para methyl-methyl coupled and the ortho-para methyl-methyl coupled products as well as an unidentified dimeric product.

The cresol salts suitable for use in the present process are represented by the formula:

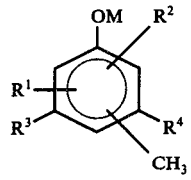

wherein M is either a metal cation having a higher reduction potential (more negative discharge potential) than that of the hydrogen ion (proton), or a quaternary ammonium ion, with suitable metals including, for example, the Group 1a metals (alkali metals) such as lithium, sodium, potassium, rubidium, and cesium, the Group 2a metals (alkaline earth metals) such as magnesium, calcium, strontium, and barium, and the Group 3a metals such as aluminum, gallium, indium, and thallium and suitable quaternary ammonium ions including, for example, tetraalkylammonium such as tetraethylammonium, tetra-n-butylammonium, and the like, alkylarylammonium such as phenyltrimethylammonium, diphenyldimethylammonium, and the like; each of $R^1$ and $R^2$ are independently non-interfering, blocking substituents, including, for example, alkyl of 1 to 10 carbon atoms, alkoxy containing an alkyl of 1 to 10 carbon atoms, amino, alkylamino, and dialkylamino containing alkyls, including cyclic mono-, of 1 to 10 carbon atoms each, or phenyl, and each of $R^3$ and $R^4$ independently are, for example, hydrogen or $R^1$ and $R^2$; with the proviso that $R^1$ and $R^2$, and the cresolic methyl are always located at the 2,4,6-positions relative to the phenolic oxyanion. Representative of such cresol salts are the metal and quaternary ammonium salts of 2,4,6-trimethylphenol, 2,4-dimethyl-6-t-butylphenol, 2,4-di-t-butyl-6-methylphenol, 2,6-di-t-butyl-4-methylphenol, 2,4-di-t-pentyl-6-methylphenol, 2,6-di-t-pentyl-4-methylphenol, 2,6-bis(N,N-dimethylamino)-4-methylphenol, 2,4-dimethoxy-6-methylphenol, and the like. Of these, the Group 1a metal and tetraalkylammonium salts of the di-t-butyl-methylphenols and the di-t-pentylmethylphenols are preferred because (a) they are readily available and/or easily prepared; (b) undesirable side reactions to produce difficult to purify mixtures of coupled products are eliminated by the absence of any benzylic hydrogens in the t-butyl and t-pentyl substituents (although it will be noted that the corresponding 2,4,6-trimethylphenol salt also does not present this problem under process condition employed herein); (c) the t-butyl and t-pentyl substituents are easily removed from the methyl-methyl coupled dehydrodimeric product by known procedures to yield 1,2-bis(hydroxyphenyl)ethanes. Of these cresol salts, the most preferred are those of 2,6-di-t-butyl-4-methylphenol.

As is common with salts in general, the cresol salts required for use in the present invention exist as a cation and an anion; that is, as a metal or quaternary ammonium cation and a substituted phenoxide (or cresoxide) anion. Such salts are readily prepared by contacting the corresponding free cresol with an appropriate base of the Group 1a and Group 2a metals, a quaternary ammonium hydroxide, or by heating together the corresponding free cresol and a Group 3a metal. It will be noted, however, that as a consequence of the ready availability and/or ease or preparation of suitable bases of Group 1a metals such as sodium methoxide, potassium t-butoxide, and the like, tetraalkylammonium hydroxides such as tetraethylammonium hydroxide, tetra-n-butylammonium hydroxide, and the like, coupled with the ease with which such bases react with free cresols to form the corresponding cresol salts when brought into intimate contact with such free cresols, the Group 1a metal and tetraalkylammonium cations are the cations of choice.

It will be noted that the characteristically lower oxidation potential of the phenoxide anion as compared to that of the corresponding free phenol results in a more facile oxidation. This phenomenon permits the electrolytic oxidation of the present process to be carried out even when other easily oxidizable substituents, such as, for example, amino, alkylamino, and dialkylamino are present in the compound. The various undesirable coupling reactions resulting from the oxidation of such easily oxidizable substituents are substantially eliminated in that the facility with which the phenoxide anion is oxidized permits the desired oxidation and subsequent methyl-methyl coupling reaction to be carried out without interference from such substituents.

While not desiring to be bound by the theory of the present invention or to limit the present invention in any way, it will be noted that two different mechanistic pathways are possible for anodic oxidation of phenols: (a) a two-electron loss from the free un-ionized phenol to give a phenoxonium cation and (b) the removal of one electron from the phenoxide anion to give a phenoxy radical. The phenoxonium cation, bearing a positive charge, can readily undergo elimination reactions (when appropriately substituted) and especially addition reactions with any available nucleophile to yield undesirable side-products as described in Vermillion, Jr., et al., *Journal of the Electrochemical Society*, 111(12), 1392 (1964). Conversely, the phenoxy radical undergoes coupling reactions in preference to either elimination or nucleophilic addition reactions.

As a consequence of the facility with which the phenoxide (or cresoxide) anion is oxidized, coupled with the preference of the phenoxy radical to undergo coupling as opposed to either elimination reactions or addition reactions with available nucleophiles, the electrolytic oxidation of appropriately substituted cresol salts to produce the desired methyl-methyl coupled dehydrodimeric cresols is accomplished while employing only a catalytic amount of base (when used to prepare the cresol salts).

The molar equivalent ratio of cresol salt to free cresol can vary over wide limits. It has been found that even if only trace amounts of cresol salt are present as a component in the electrolysis medium the desired electrolytic oxidative methyl-methyl coupling reaction will nevertheless occur, albeit at very slow rates. Conversely, if the molar equivalent ratio of cresol salt to free cresol is greater than about 1.0 molar equivalent of cresol salt to 5.0 molar equivalents of free cresol, a higher rate of reaction is observed, but the yield of the desired dehydrodimeric cresol product is decreased as a result of the increased production of undesirable by-products, such as, for example, 2,6-di-t-butyl-4-methoxymethylphenol when sodium 2,6-di-t-butyl-4-methylphenoxide (prepared from 2,6-di-t-butyl-4-methylphenol and sodium methoxide) is used as the cresol salt.

Thus, in order to effect the desired electrolytic oxidative methyl-methyl coupling reaction within a reasonable time period and to optimize the yield of the dehydrodimeric cresol product, it is preferred that the molar equivalent ratio of cresol salt to free cresol range between about 1.0 molar equivalent of cresol salt to between about 5.0 and 100 molar equivalents of free cresol, with a molar equivalent ratio range between about 1.0 molar equivalent of cresol salt to between about 10 and 25 molar equivalents of free cresol being particularly preferred.

The preferred molar equivalent ratio of cresol salt to free cresol can be readily achieved by any number of means known to the art. For example, it can be achieved (a) by adding an appropriate amount of a suitable base (when employed) to the electrolysis medium (minus the cresol salt component) to convert the desired quantity of free cresol to the corresponding cresol salt; or (b) by admixing the appropriate quantities of cresol salt and free cresol in the solvent of the electrolysis medium. The latter means is especially convenient when the cresol salts are Group 3a metal phenoxides.

As indicated hereinabove, the electrolysis of the present process is effected by passing an electric current through a liquid electrolysis medium comprising the cresol salt, the corresponding free cresol, and solvent, wherein the molar equivalent ratio of cresol salt to free cresol is no more than about 1.0 molar equivalent of cresol salt to about 5.0 molar equivalents of free cresol, which medium is in contact with an anode. The medium must have sufficient conductivity to conduct the electrolysis current. While media of poor conductivity can be employed, it is preferred from an economic viewpoint not to have too high a resistance. The required conductivity is generally achieved by employing common supporting electrolytes, such as electrolyte salts whose anions have sufficiently positive discharge potentials, along with a liquid having a fairly good dielectric constant. In general, any combination of electrolyte and solvent can be employed which gives the desired conductivity and is sufficiently compatible with the cresol salt to permit its electrolytic oxidative coupling to the desired product. It is generally desirable to have the electrolyte, when employed, cresol salt, the corresponding free cresol, and solvent in a fairly homogeneous dispersion, but a true solution is not required as, for example, many quaternary ammonium salt solutions may, in some respects, be dispersions rather than true solutions. Thus the present invention may use emulsions as well as true solutions so long as sufficient amounts of the cresol salt are dissolved or in solution so as to permit the desired oxidation to occur at a reasonable rate. Moreover, in emulsions or media having more than one phase, electrolysis can occur in a solution of the components in one of the phases.

The electrolytic oxidative methyl-methyl coupling of the present process can be carried out in either substantially anhydrous media or media containing small amounts of added water. The added water is especially convenient when increased dissolving power of the solvent is desired. Large amounts of added water, however, are to be avoided in that by virtue of the increased nucleophilicity of the solvent, the tendency of the cresol salt, even though present as the phenoxide anion, to undergo a two-electron oxidation to the corresponding phenoxonium cation with its propensity to undergo elimination reactions, and addition reactions with available nucleophiles to give undesirable by-products is significantly increased. When water is added, suitable concentrations will often be in the range of about 1.0 percent to about 20 percent by volume, with the preferred concentration being about 10 percent by volume.

In the solvents employed in the present process, it will generally be desirable to select a solvent (a) which is relatively inert under process conditions and (b) of fairly high dielectric constant in order to lower the electrical resistance. It will be understood, however, that the choice and concentration of electrolyte (as well as electrode materials) can also be used to lower electrical resistance.

The term "relatively inert" is employed herein to describe solvents which, under process conditions, (a) do not preferentially undergo electrochemical reaction and (b) do not significantly react with either the starting materials (cresol salts), intermediates generated therefrom, or the desired final products (methyl-methyl coupled dehydrodimeric cresols).

Solvents desirable for use herein have, in addition to characteristics (a) and (b) set forth hereinabove, low nucleophilicity; that is, suitable solvents are substantially non-nucleophilic. Further, it is found in practice that it is generally desirable to employ a solvent with a dielectric constant of at least 25, and preferably of at least 50. Examples of such solvents include, for example, acetonitrile, propanenitrile, benzonitrile, dimethylformamide, hexamethylphosphoramide, sulfolane, and the like.

In carrying out the present process, a supporting electrolyte is generally used to enhance conductivity. With some combinations of cresol salts and solvents, an additional electrolyte may not actually be necessary, but in practice a supporting electrolyte is utilized in the present invention. A "supporting electrolyte," as understood by those in the art, is an electrolyte capable of carrying electric current but not discharging under electrolysis conditions. In the present invention this primarily concerns discharge at the anode, as the desired reaction occurs at the anode. Thus the electrolyte employed will generally have anions of more positive anodic discharge potentials than the discharge potential of the cresol salt used. An electrolyte with a similar or slightly lower discharge potential than the cresol salt may be operative to some extent, but yields and current efficiency are adversely affected, so it is generally desirable to avoid any substantial discharge of the electrolyte salt during the electrolysis.

It will be recognized that discharge potentials will vary with anode materials and their surface conditions, and various materials in the electrolysis medium. In order for the reaction to proceed, however, it is necessary only to have an effective oxidation of the cresol salt under process conditions. Thus some electrolyte salts may be effective supporting electrolytes under process conditions even though nominally of less positive discharge potential than the cresol salt employed.

In general, any supporting electrolyte salts can be utilized in carrying out the present process, with due consideration to having conditions suitable for discharge of the cresol salt involved. The term "salt" is employed in its generally recognized sense to indicate a compound composed of a cation and an anion, such as produced by a reaction of an acid with a base. The electrolyte salts can be organic, inorganic, or mixtures of such, and composed of simple cations and anions or very large complex cations and anions. In general, however, salts of carboxylic acids are to be avoided in order to eliminate the possibility of Kolbe oxidation.

Certain salts of alkali and alkaline earth metals can be employed as supporting electrolytes to some extent, however, amine and quaternary ammonium salts are generally more suitable and preferred for use in the present invention. Among the quaternary ammonium salts useful are the tetraalkylammonium, for example, tetramethylammonium, tetraethylammonium, tetra-n-propylammonium, and the like, heterocyclic and araalkylammonium salts, for example, benzyltrimethylammonium, and the like.

The term "quaternary ammonium" as employed herein has its usual recognized meaning of a cation having four organic groups substituted on the nitrogen.

Various anions can be used with the foregoing and other cations, such as, for example, perchlorates, tetrafluoroborates, hexafluorophosphates, phosphates, sulfates, sulfonates, tetraphenylborides, and the like. Aromatic sulfonates and similar anions, including those referred to as McKee salts, can be used, as can other hydrotropic salts, although the hydrotropic property may be of no particular significance when employed with solvents having very low water content. Of the foregoing and other anions, the perchlorates are particularly preferred because of their inertness to oxidation and their almost complete lack of complex formation.

The concentration of electrolyte salts, when used, can vary widely, for example, from about 0.5 percent to about 50 percent or more by weight of the electrolysis medium, but suitable concentrations will often be in the range of about 1.0 percent to about 15 percent by weight or on a molar basis, often in the range of about 0.1 to about 1.0 molar. If, however, it is desired to have all the components in solution, the amount of electrolyte salt utilized will be no greater than will dissolve in the electrolysis medium.

In carrying out the present process, the electrolysis medium (or the anolyte and catholyte when a divided cell is used) will generally be basic, insofar as acidity and basicity is concerned. It will usually be desirable to operate under basic conditions in order to minimize undesirable side reactions. Attention is drawn to the fact that under basic conditions the phenoxide anion is the predominant species undergoing the desired electrolytic oxidation. And, as noted hereinabove, the characteristically lower oxidation potential of the phenoxide anion results in a more facile oxidation and permits the desired methyl-methyl coupling reaction to be carried out to produce dehydrodimeric cresols (1,2-bis(hydroxyaryl)ethanes. It will be further noted that satisfactory results may also be obtained when the reaction is carried out on the cresol salt in an essentially neutral medium. It will be still further noted that while no particular provisions are necessary to regulate the pH of the electrolysis medium, acidic conditions are to be avoided in that the cresol salts suitable for use herein are converted to the corresponding free, un-ionized cresols under such conditions. These cresols on being subjected to electrolytic oxidation are converted to phenoxonium ions which, as noted hereinabove, undergo undesirable elimination reactions and addition reactions with available nucleophiles.

In long-term, continuous operations involving re-use of the electrolysis media, it may be desirable to use buffers or to periodically adjust the pH to desired values so as to maintain the desired basic conditions.

The concentration of the cresol salt can very widely, for example, from about 0.1 percent to about 50 percent or more by weight of the electrolysis medium. In general, however, the concentration will often be in the range between about 1.0 percent and about 15 percent by weight. Also present as a component of the electrolysis medium along with the cresol salt is the corresponding concentration of free cresol whose actual value will depend on the molar equivalent ratio of cresol salt to free cresol employed.

As noted hereinbefore for the electrolyte salts, if it is desired to have all the components in solution, the amount of cresol salt (and the corresponding amount of free cresol) utilized will be no greater than will dissolve in the electrolysis medium. It will be further noted, however, that while complete solution of the cresol salt is desirable, it is not necessary for successful completion of the reaction of the present process. It is necessary only to have sufficient amounts dissolved in order to permit the desired oxidative methyl-methyl coupling reaction to proceed at a reasonable rate. As the reaction proceeds under such conditions, additional cresol salt dissolves to continue the reaction. But regardless of whether the cresol salt (as well as free cresol) is completely dissolved, as the reaction proceeds, additional free cresol is converted to cresol salt, thereby maintaining a continuous supply of cresol salt available for reaction so long as some free cresol remains.

In continuous operations, the cresol salt concentration will probably be maintained close to some constant value, and the methyl-methyl coupled dehydrodimeric cresol product will also be present in fair amount in the electrolysis medium, depending upon the conversion obtained, as determined by the timing and amount of product separation. For example, the process can be operated at conversion rates of about 20 to 80 percent or so (or other desired rate), and the unreacted cresol salt recycled.

In general the anode potential can be maintained at a selected value or it can be varied. It will be apparent, however, that in order to minimize any possible adverse alteration in the course of the reaction or product distribution, the anode potential is preferably no greater than that which is necessary to effect the desired oxidative methyl-methyl coupling of the cresol salt to the dehydrodimeric cresol. That is, the anode potential will be sufficiently positive to effect a one-electron oxidation of the phenoxide anion of the cresol salt to the phenoxy radical but insufficiently positive to effect to any substantial extent a two-electron oxidation to the phenoxonium cation. Suitable anode potentials will often be no more than about +0.5 volt (versus the saturated calomel electrode), although it will be recognized that the value will vary with anode materials and their surface conditions, and various materials in the electrolysis medium.

Various current densities can be employed in the present process. It will be desirable to employ high current densities in order to achieve high use of electrolysis cell capacity, and therefore for production purposes it will generally be desirable to use as high a density as feasible, taking into consideration sources and cost of electrical current, resistance of the electrolysis medium, heat dissipation, effect upon yields, and the like. Over broad ranges of current density, the density will not greatly affect the yield. Suitable ranges for efficient operation will generally be in the ranges from a few milliamperes per square decimeter of anode surface, up to 10 or 100 or more milliamperes per square decimeter.

The present electrolysis can be conducted in the various types of electrolysis cells known to the art. In general, such cells comprise a container made of material capable of resisting action of electrolytes, for example, glass or plastic, and one or more anodes and cathodes connected to a source of electric current, such as a battery and the like. The anode can be of any electrode material so long as it is relatively inert under reaction conditions. Anode materials suitable for use in the present process include, for example, graphite, platinum, lead (IV) oxide, gold, and the like. Of these anode materials, graphite in the form of felt, that is, graphite felt, is preferred because of its high surface area.

Any suitable material can be employed as the cathode, various metals, alloys, graphite, and the like being known to the art. For example, platinum, palladium, mercury, lead, and carbon cathodes are suitable.

In the present process either an undivided or a divided cell can be employed. A divided cell contains a suitable barrier material or separator which will prevent the free flow of reactants between the anode and cathode. Generally, the separator is some mechanical barrier which is relatively inert to electrolyte material, for example, a fritted glass filter, glass cloth, asbestos, porous poly(vinyl chloride), and the like. An ion exchange membrane can also be employed.

When a divided cell is used, it will be possible to employ the same electrolysis medium on both the anode and cathode sides, or to employ different media. Ordinarily, it will be desirable to employ the same electrolyte salt and solvent on both the anode and cathode sides; however, in some circumstances, it may be desirable to employ a different catholyte for economy of materials, lower electrical resistance, and the like.

As noted hereinabove, an undivided cell is also suitable for use in the present process. It will be appreciated that this could have advantages for industrial production in that electrical resistance across a cell divider is eliminated.

The electrolysis cells, *whether divided or undivided,* employed in the procedural Examples hereinbelow are primarily for laboratory demonstration purposes. Production cells are usually designed with a view to the economics of the process, and characteristically have large electrode surfaces, and short distances between electrodes.

For a general description of various laboratory scale cells, see Lund et al, "Practical Problems in Electrolysis," in *Organic Electrochemistry* (Baizer, ed.), Marcel Dekker, New York, 1973 pp. 165–249, and for some considerations of industrial cell designs, see Danly, "Industrial Electroorganic Chemistry," in Ibid, pp. 907–946.

The present process is suited to either batch or continuous operations. Continuous operations can involve recirculation of a flowing electrolyte stream, or streams between the electrodes, with continuous or intermittent removal of the product from the stream.

Similarly, additional reactants can be added continuously or intermittently, and electrolyte salt or other electrolyte components can be augmented, replenished, or removed as appropriate.

The electrolysis can be conducted at ambient temperatures, or at higher or lower temperatures. However, it may be desirable to avoid excessively high or elevated temperatures in that increased production of undesirable by-products may result. It may also be desirable to avoid elevated temperatures if volatile materials (solvents) are utilized so that such materials will not escape, and various cooling means can be used for this purpose. Cooling to ambient temperatures is sufficient, but, if desired, temperatures down to 0° C or lower can be employed as long as the temperature is sufficient to permit the desired oxidation and subsequent methyl-methyl coupling to occur. The amount of cooling capacity needed for the desired degree of control will depend upon the cell resistance and the electrical current drawn. If desired, cooling can be effected by immersing the electrolysis cell in an ice or ice-salt bath or by permitting a component, such as the solvent, to reflux through a cooling condenser. Pressure can be employed to permit electrolysis at higher temperatures with volatile solvents, but unnecessary employment of pressure is usually undesirable from an economic standpoint.

The present electrolysis is preferably carried out under an inert atmosphere or the like in order to remove and prevent the presence of residual oxygen (and moisture when anhydrous conditions are desired). Nitrogen gas admirably serves this purpose. It is passed through the electrolysis medium both prior to and during the electrolysis in order to minimize undesirable side reactions, such as, for example, peroxide formation.

The dehydrodimeric cresol products [1,2-bis(hydroxyaryl)ethanes] obtained in the present process can be readily recovered by any of a number of well known procedures as the free dehydrodimeric cresol or derivatives thereof, such as, for example, the corresponding diacyloxy compound. It will be understood, however, that the isolation procedures employed in the procedural examples and discussed hereinbelow are primarily for illustrative purposes. Other procedures can be employed, and may be preferred, for commercial use.

Upon completion of the electrolysis, the reaction mixture is made acidic by the addition of an appropriate mineral acid, such as, for example, concentrated hydrochloric acid, and filtered. The anode, if graphite felt, may be either washed intact with an appropriate solvent, or it may initially be chopped into a finely divided mass prior to being washed to extract the dehydrodimeric cresol product. Other suitable anodes, when employed, may simply be washed with an appropriate solvent to remove any product adhered thereto. Suitable solvents include, for example, chloroform, methylene chloride, and the like.

The reaction mixture filtrate and the extraction solvent washings are combined and evaporated in vacuo to yield a solid residue which is subsequently dissolved in an appropriate solvent, such as, for example, chloroform or methylene chloride, washed with water, dried over an appropriate dessicant, such as, for example, magnesium sulfate, filtered, and evaporated in vacuo to yield the crude dehydrodimeric cresol product. Recrystallization from a suitable solvent such as ethanol, acetone, and the like yields the pure dihydrodimeric cresol product.

Alternatively, the product is isolated as the corresponding diacyloxy compound. The crude dehydrodimeric cresol, isolated as described hereinabove, is dissolved in an appropriate solvent, such as, for example, chloroform or absolute ether and treated at low temperatures, such as, for example, about 0° C under an inert atmosphere with an acylating agent such as acetyl chloride, acetic anhydride, and the like in the presence of a suitable base, such as, for example, triethylamine. The resulting solution is washed successively with water, a saturated aqueous solution of a mild base, such as, for example, sodium bicarbonate, and water, dried over an appropriate dessicant, and evaporated in vacuo. The resulting residue is readily recrystallized from a suitable solvent such as ethanol, acetone, and the like to yield the pure product.

It will be noted that since the diacyloxy derivatives are esters, the free dehydrodimeric cresols can, if desired, be readily recovered therefrom by standard procedures.

It will also be noted that when, in addition to the phenolic hydroxyl groups, other easily acylated substituents, such as, for example, amino groups are present in the molecule, they too will undergo acylation. And unless the polyacylated compound is desired, it may be preferable in such instances to isolate the product as the free dehydrodimeric cresol.

When at least $R^1$ and $R^2$ are tertiary alkyl groups, such as, for example, t-butyl or t-pentyl, the dehydromeric cresol product can be easily dealkylated by known procedures. For example, 1,2-bis(3,5-di-t-butyl-4-hydroxyphenyl)ethane, upon being heated with a catalytic amount of p-toluene-sulfonic acid, is readily dibutylated to give 1,2-bis(4-hydroxyphenyl)ethane, also known as bisphenol E. It will be noted that the isobutene generated during the debutylation reaction can be reacted with p-cresol (4-methylphenol) to give 2,6-di-t-butyl-4-methylphenol.

Thus the present invention provides a convenient route from appropriately substituted cresol salts to bisphenol E.

The following examples illustrate the present invention and the manner by which it can be practiced.

EXAMPLE 1

1,2-Bis(3,5-di-t-butyl-4-hydroxyphenyl)ethane

A 400-milliliter beaker lined with a graphite felt anode (4 inches × 7 inches, 10.16 centimeters × 17.78 centimeters) and with a platinum screen cathode (1 inch × 2 inches; 2.54 centimeters × 5.08 centimeters) placed concentrically was used as an electrolysis cell. A saturated calomel electrode was positioned just next to the anode surface to serve as a reference electrode.

The electrolysis cell was charged with 300 milliliters of 10 percent aqueous acetonitrile and 6.9 grams (0.03 mole) of tetraethylammonium perchlorate. Nitrogen gas was passed through the system while 4.4 grams (0.02 mole) of 2,6-di-t-butyl-4-methylphenol, and 0.108 gram (0.002 mole) of sodium methoxide were added. The electrolysis was conducted at ambient temperatures under a nitrogen atmosphere at an anode potential of +0.35 volt (versus the saturated calomel electrode). The initial current of 210 milliamperes decreased to 16 milliamperes over the 10-hour electrolysis period. Upon completion of the electrolysis, the reaction mixture was acidified with 2.0 milliliters of concentrated hydrochloric acid and allowed to stand overnight (about 15 hours). The graphite felt anode was washed with two 50-milliliter portions of chloroform to remove the precipitate which had collected thereon during both the electrolysis and the standing period. The chloroform solution was dried over anhydrous magnesium sulfite and evaporated in vacuo to yield pure crystals of 1,2-bis(3,5-di-t-butyl-4-hydroxyphenyl)ethane (3.88 grams, 88.6 percent), melting point 170°–171° C.

Vapor phase chromatographic analysis of the residue obtained by evaporation in vacuo of the cell contents to dryness, dissolving the resulting residue in ether followed by washing with water, drying, and evaporation in vacuo to dryness showed only unreacted 2,6-di-t-butyl-4-methylphenol, with no 2,6-di-t-butyl-4-methoxymethylphenol being detected.

EXAMPLE 2

1,2-Bis(2-acetoxy-3,5-dimethylphenyl)ethane

A solution of 6.0 grams (0.026 mole) of tetraethylammonium perchlorate dissolved in 300 milliliters of acetonitrile was charged to the electrolysis cell described in EXAMPLE 1 above. The solution was covered with a rubber dental dam and degassed with nitrogen for 0.5 hour. 2,4,6-Trimethylphenol (5.44 grams, 0.04 mole) and 0.22 gram (0.004 mole) of sodium methoxide were thereafter charged to the degassed solution. Electrolysis was conducted at ambient temperatures under a nitrogen atmosphere over a 6.2-hour period at an anode potential of +0.3 volt (versus the saturated calomel electrode). The initial current of 330 milliamperes decreased to 31 milliamperes over the electrolysis period. After completion of the electrolysis, the reaction mixture was made slightly acidic by adding 10 percent aqueous hydrochloric acid. The mixture was allowed to stand overnight (about 16 hours) and decanted from the cell. The graphite felt anode was washed successively with three 100-milliliter portions of chloroform, which washings were combined with the decanted reaction mixture, filtered, and evaporated to dryness. The residue was dissolved in 100 milliliters of chloroform, washed with two 50 milliliter portions of water, dried over anhydrous magnesium sulfate, and filtered. The chloroform solution was cooled to 0° C while 6.0 grams (0.0923 mole) of triethylamine were added under a nitrogen atmosphere. Acetyl chloride (6.0 grams, 0.076 mole) was then added dropwise over a 1-hour period in order to maintain the reaction mixture temperature between about 0° C and about 5° C. When the addition was complete, the reaction mixture was allowed to warm to ambient temperatures over a 1-hour period. The chloroform solution was washed successively with 100-milliliter portions of water, saturated aqueous sodium bicarbonate, and water, and dried. Gas chromatographic analysis of the solution showed the presence of 1,2-bis(2-acetoxy-3,5-dimethylphenyl)ethane in 91 percent yield. Evaporation of the solvent yielded a residue which was recrystallized from a minimum of ethanol to yield 4.5 grams of product, melting point 130°–131° C. The ethanolic filtrate was warmed, saturated to cloudiness with water, and cooled to induce crystallization. The precipitate was collected by suction filtration to yield an additional 1.7 grams of product, melting point 129°–130.5° C, for a total yield of 6.2 grams (87.6 percent) of 1,2-bis(2-acetoxy-3,5-dimethylphenyl)ethane.

The 1,2-bis(hydroxyaryl)ethanes, as dehydrodimeric cresols, are useful as bactericides, chemical intermediates, comonomers, and antioxidants. They are used to stabilize such materials as animal and vegetable fats or oils, gasoline, lubricants, polyalkenes such as polyethylene and polypropylene, and both natural and synthetic rubber. Those dehydrodimeric cresols in which the phenolic hydroxyl group is not sterically hindered by large bulky substituents in the ortho-positions relative to the phenolic hydroxyl may also be used in the preparation of resins, for example, polyesters, polycarbonates, and the like resins, wherein they are used as the dihydroxy compound which is reacted either with phosgene, dibasic acids, dibasic acid halides, polyepoxides, polyurethanes, and the like.

While the invention has been described with respect to various specific examples and embodiments thereof, it will be understood that the invention is not limited thereto and that many alternatives, modifications, and variations will be apparent to those skilled in the art in light of the foregoing description. Accordingly, it is intended to embrace all such alternatives, modifications, and variations as fall within the spirit and broad scope of the invention.

What is claimed is:

1. An improved process for electrolytic oxidative methyl-methyl coupling of cresol salts substituted with non-interfering, blocking substituents at least at the 2, 4, 6-positions relative to the phenolic oxyanion where at least one of the substituents is the cresolic methyl, which process comprises electrolytic oxidation at the anode by electrolysis at no more than about 0.5 volts (versus the saturated calomel electrode) in a liquid electrolysis medium comprising the cresol salt, the corresponding free cresol, and a substantially non-nucleophilic solvent, wherein the molar equivalent ratio of cresol salt to free cresol is no more than about 1.0 molar equivalent of cresol salt to about 5.0 molar equivalents of free cresol, and thereafter recovering a methyl-methyl coupled dehydrodimeric cresol.

2. The process of claim 1 wherein the cresol salt is a 2,4,6-trialkylphenol salt.

3. The process of claim 2 wherein the 2,4,6-trialkylphenol salt is a 2,6-di-t-butyl-4-methylphenol salt.

4. The process of claim 2 wherein the 2,4,6-trialkylphenol salt is a 2,4,6-trimethylphenol salt.

5. The process of claim 1 wherein the cresol salt is a Group 1a metal or tetraalkylphenoxide and the methyl-methyl coupled dehydrodimeric cresol is a 1,2-bis(3,5-dialkyl-hydroxyphenyl)ethane.

6. The process of claim 5 wherein the Group 1a or tetraalkylammonium 2,4,6-trialkylphenoxide is sodium 2,6-di-t-butyl-4-methylphenoxide and the 1,2-bis(3,5-dialkyl-hydroxyphenyl)ethane is 1,2-bis(3,5-di-t-butyl-4-hydroxyphenyl)ethane.

7. The process of claim 5 wherein the Group 1a or tetraalkylammonium 2,4,6-trialkylphenoxide is sodium 2,4,6-trimethylphenoxide and the 1,2-bis(3,5-dialkyl-hydroxyphenyl)ethane is 1,2-bis(2-hydroxy-3,5-dimethylphenyl)ethane.

8. The process of claim 5 wherein the Group 1a or tetralkylammonium 2,4,6-trialkylphenoxide is tetra-n-butylammonium 2,4,6-trimethylphenoxide and the 1,2-bis(3,5-dialkyl-hydroxyphenyl)ethane is 1,2-bis(2-hydroxy-3,5-dimethylphenyl)ethane.

9. The process of claim 1 wherein the electrolysis medium is basic.

10. The process of claim 1 wherein the solvent is substantially anhydrous.

11. The process of claim 10 wherein the substantially anhydrous solvent is acetonitrile.

12. The process of claim 1 wherein the solvent contains small amounts of added water.

13. The process of claim 12 wherein the solvent containing small amounts of added water is acetonitrile.

14. The process of claim 12 wherein the concentration of the small amounts of added water is about 10 percent by volume.

15. The process of claim 1 wherein a supporting electrolyte is used.

16. The process of claim 15 wherein the concentration of the supporting electrolyte is between about 1.0 percent and about 15 percent by weight.

17. The process of claim 15 wherein the supporting electrolyte is a quaternary ammonium salt.

18. The process of claim 17 wherein the quaternary ammonium salt is tetraethylammonium perchlorate.

19. The process of claim 1 wherein a graphite felt anode and a platinum screen cathode are used.

20. The process of claim 1 wherein the molar equivalent ratio of cresol salt to the corresponding free cresol is between about 1.0 molar equivalent of cresol salt to between about 10 and 25 molar equivalents of free cresol.

21. The process of claim 1 wherein the concentration of cresol salt in the electrolysis medium is between about 1.0 percent and about 15 percent by weight; the anode potential is sufficient to effect oxidative methyl-methyl coupling of the cresol salt; and the electrolysis is conducted at ambient temperatures.

* * * * *